US007494372B2

(12) United States Patent
Peng et al.

(10) Patent No.: US 7,494,372 B2
(45) Date of Patent: Feb. 24, 2009

(54) CARD-EDGE CONNECTOR

(75) Inventors: Vincent Peng, Taipei (TW); Wayde Chen, Taipei (TW); Eason Liu, Taipei (TW)

(73) Assignee: Tyco Holdings (Bermuda) No. 7 Limited, Pembroke (BM)

( * ) Notice: Subject to any disclaimer, the term of this patent is extended or adjusted under 35 U.S.C. 154(b) by 148 days.

(21) Appl. No.: 11/839,639

(22) Filed: Aug. 16, 2007

(65) Prior Publication Data

US 2008/0146080 A1 Jun. 19, 2008

(30) Foreign Application Priority Data

Aug. 16, 2006 (TW) ..... 95130116 A

(51) Int. Cl.
*H01R 13/60* (2006.01)
*H01R 13/648* (2006.01)

(52) U.S. Cl. ..... 439/541.5; 439/607

(58) Field of Classification Search ..... 439/607, 439/541.5, 540.1

See application file for complete search history.

(56) References Cited

U.S. PATENT DOCUMENTS 6,077,119 A * 6/2000 Yu et al. ..... 439/607
6,176,737 B1 * 1/2001 Choy ..... 439/541.5
6,672,899 B2 * 1/2004 Morita et al. ..... 439/541.5
7,070,446 B2 * 7/2006 Henry et al. ..... 439/541.5

FOREIGN PATENT DOCUMENTS

TW M283400 12/2005

* cited by examiner

*Primary Examiner*—Briggitte R Hammond
(74) *Attorney, Agent, or Firm*—Barley Snyder LLC

(57) ABSTRACT

A card-edge connector for fixing and electrically connecting at least a first electrical card and a second electrical card to a circuit board includes a first insulating housing having a first card receiving slot and a second insulating housing having a second card receiving slot. The second insulating housing is mounted opposite from the first insulating housing such that the second card receiving slot faces the first card receiving slot. A first holding member is disposed on the second insulating housing for retaining the first electrical card in the first card receiving slot. A second holding member is disposed on the first insulating housing for retaining the second electrical card in the second card receiving slot.

20 Claims, 11 Drawing Sheets

CARD-EDGE CONNECTOR

CROSS-REFERENCE TO RELATED APPLICATIONS

This application claims the benefit of the filing date under 35 U.S.C. § 119(a)-(d) of Taiwan Patent Application No. 95130116, filed Aug. 16, 2006.

FIELD OF THE INVENTION

The present invention relates to a card-edge connector, and more particularly to a card-edge connector that fixes and electrically connects at least first and second electrical cards that are inserted into the card-edge connector in opposing directions in a stacked manner in relation to a circuit board.

BACKGROUND

The techniques of connecting an electrical card of a memory module, for example, to a circuit board are well known. In most cases, a card-edge connector is employed to connect the electrical card to the circuit board. There are different types of card-edge connectors for connecting various modularized electrical cards to a main circuit board of an electronic device. In general, contacts are disposed on a front edge of the electrical card and are electrically connected to terminals arranged in the card-edge connector to establish an electrical connection between the electrical card and the main circuit board.

In order to meet the needs of customers, it is necessary to continuously expand the capabilities of electronic devices. Hence, the above-described card-edge connector provided with only one slot for receiving a single electrical card is not capable of meeting customer needs. In order to solve this problem, Taiwan Patent No. M283400 provides a card-edge connector that comprises a step-shaped connector housing and two locking devices, which are all separately mounted to a circuit board. The step-shaped connector housing is constructed for receiving a front edge of two electrical cards on the same side thereof and holds the two electrical cards on another other side thereof with two isolated locking devices disposed on the circuit board.

Because the connector housing is step-shaped and the two electrical cards are staggeringly received in the card-edge connector, the space, particularly the length, required for mounting the step-shaped connector housing to the circuit board is still significantly large. Thus, it is necessary to reduce the amount of space required for card-edge connectors of this type.

BRIEF SUMMARY

It is therefore an objective of the present invention to provide a card-edge connector that fixes and electrically connects at least first and second electrical cards in a stacked configuration to a circuit board in order to save space. It is a further object of the present invention to provide a card-edge connector that secures at least first and second electrical cards by a simple assembly of a first holding member and a second holding member to reduce the amount of components required in the card-edge connector and to facilitate attachment and detachment of the first and second electrical cards. Still another objective of the present invention is to provide a card-edge connector that uses a partition plate to form an upper space and a lower space for securing and/or positioning at least first and second electrical cards.

This and other objects are achieved by a card-edge connector for fixing and electrically connecting at least a first electrical card and a second electrical card to a circuit board comprising a first insulating housing having a first card receiving slot and a second insulating housing having a second card receiving slot. The second insulating housing is mounted opposite from the first insulating housing such that the second card receiving slot faces the first card receiving slot. A first holding member is disposed on the second insulating housing for retaining the first electrical card in the first card receiving slot. A second holding member is disposed on the first insulating housing for retaining the second electrical card in the second card receiving slot.

This and other objects are further achieved by a card-edge connector for fixing and electrically connecting at least a first electrical card and a second electrical card to a circuit board comprising a first insulating housing having a first card receiving slot and a second insulating housing having a second card receiving slot. The first insulating housing and the second insulating housing are mounted on the circuit board such that the second card receiving slot faces the first card receiving slot. A partition plate is arranged substantially between the first card receiving slot and the second card receiving slot.

DETAILED DESCRIPTION OF THE DRAWINGS

DETAILED DESCRIPTION OF THE EMBODIMENT(S)

Figure 1:
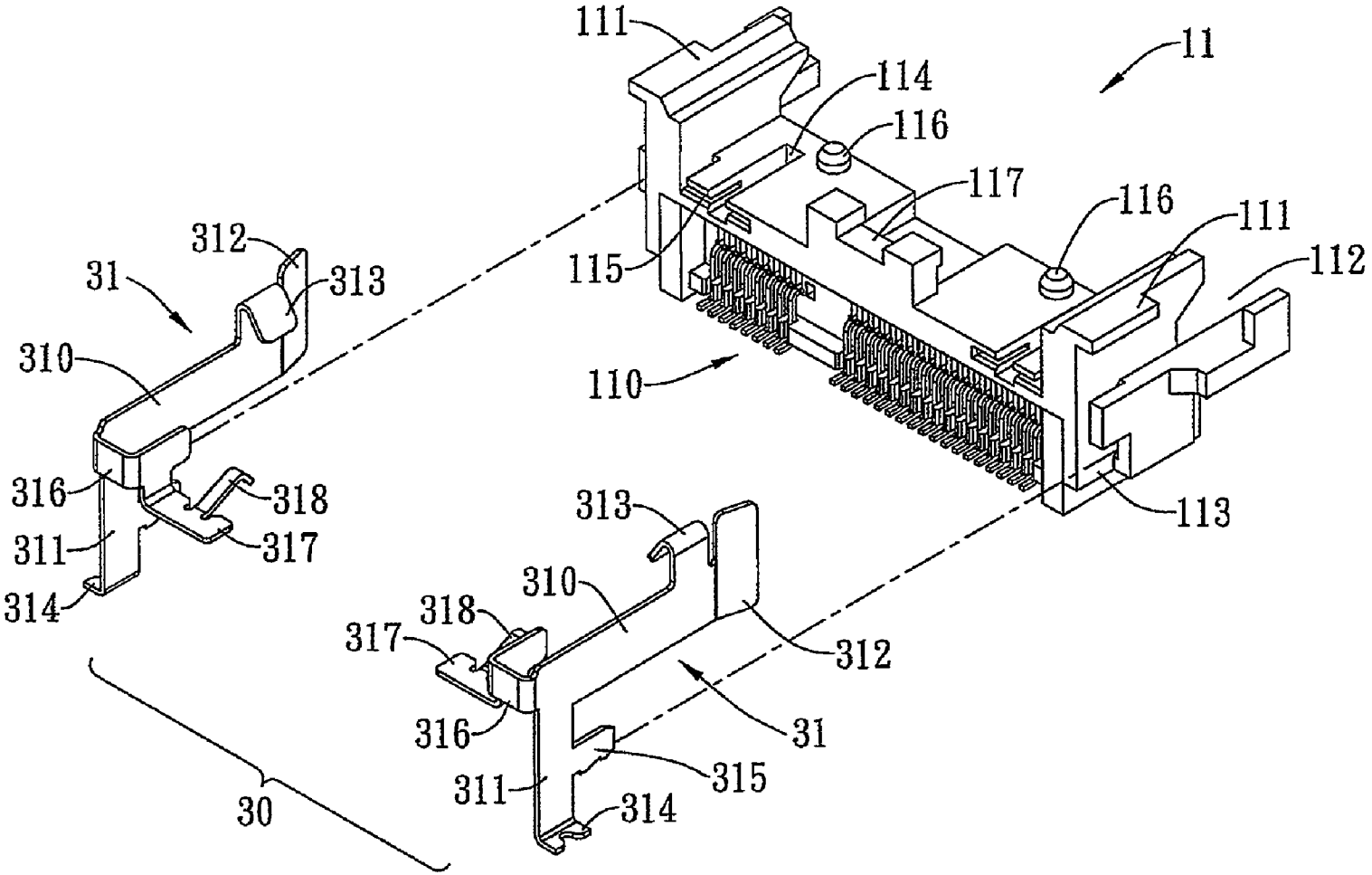
FIG. 1 is an exploded perspective view of a first insulating housing of a card-edge connector according to the present invention.
Figure 3:
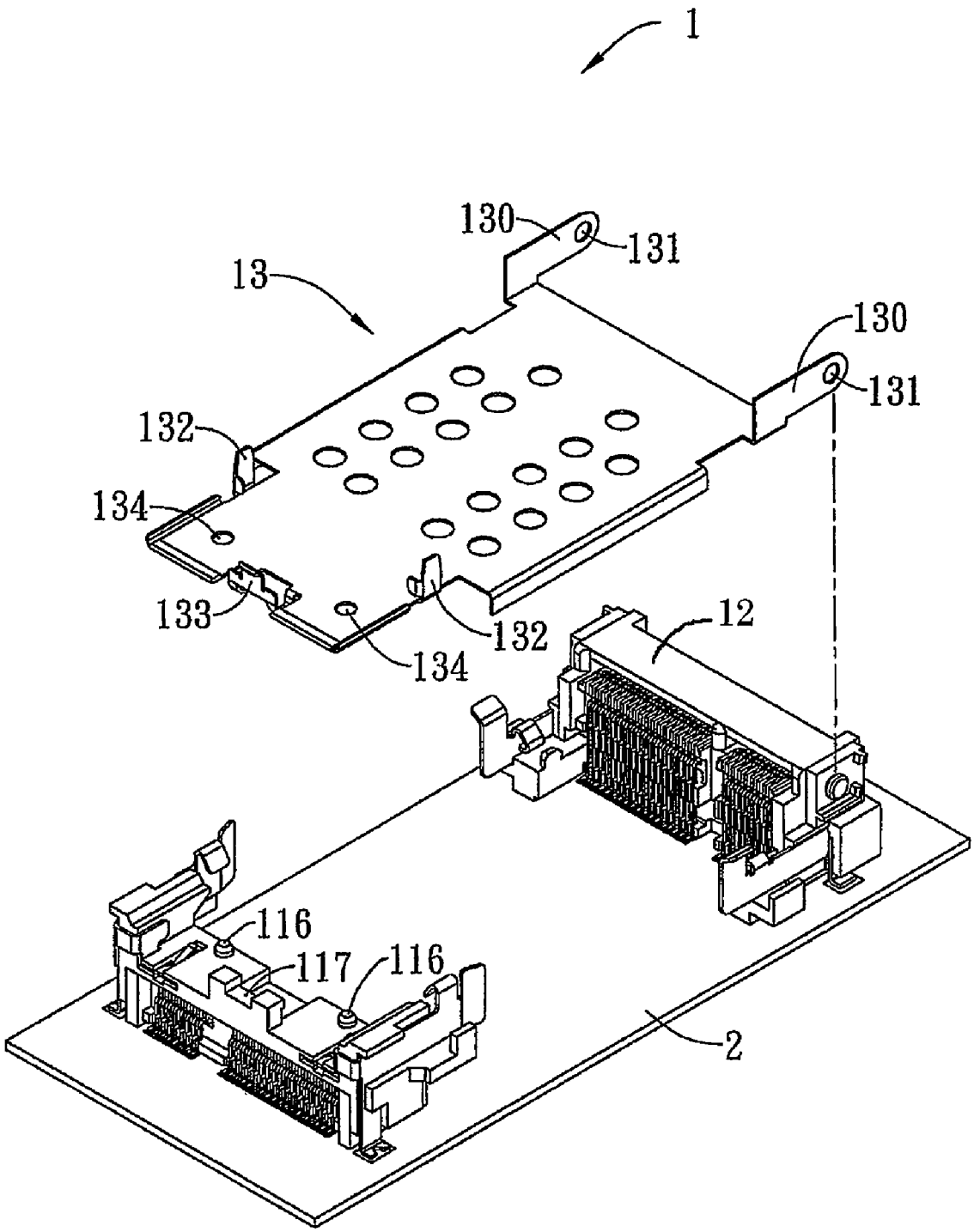
FIG. 3 is an exploded perspective view of the card-edge connector shown with a partition plate.
Figure 4:
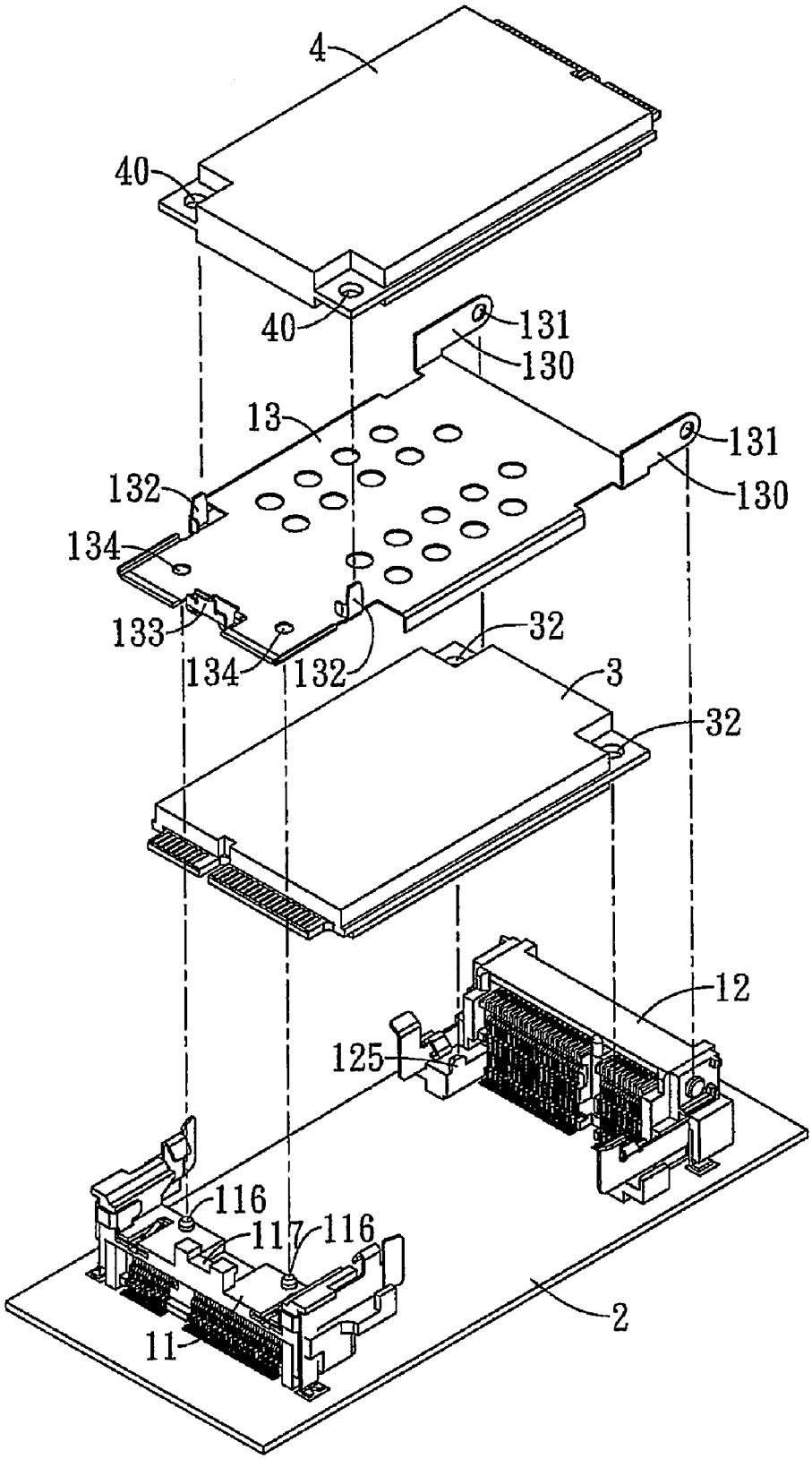
FIG. 4 is an exploded perspective view of the card-edge connector shown with the partition plate and electrical cards.

FIG. 3 shows a card-edge connector 1 according to the present invention. As shown in FIG. 3, the card-edge connector 1 comprises a circuit board 2, a first insulating housing 11, a second insulating housing 12, and a partition plate 13. As shown in FIG. 1, the first insulating housing 11 has a first card receiving slot 110. A plurality of terminal receiving grooves (not shown) is provided next to the first card receiving slot 110. Terminals are arranged within the terminal receiving grooves and are configured for electrical connection with a first electrical card 3 (FIG. 4). A first arm 111 having a substantially L-shape extends upward from both lateral sides of the first insulating housing 11. The first arm 111 has a through-groove 112 and a first connection portion 113. Grooves 114 are formed on a top surface of the first insulating housing 11. Each of the grooves has a slit 115 formed therein. A post 116 is formed near the groove 114. A positioning projection 117 is formed along a central top portion of the housing.

Figure 2:
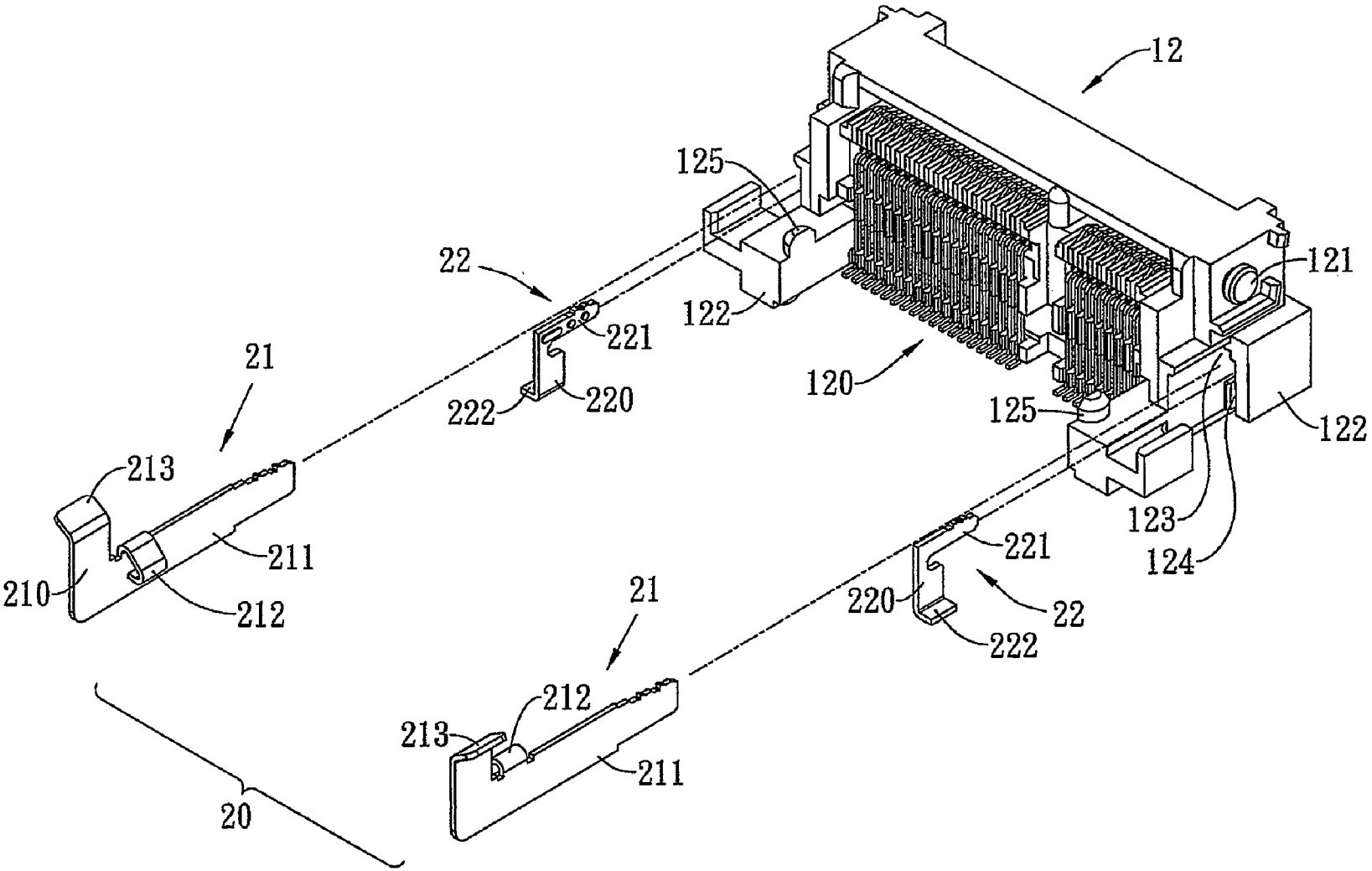
FIG. 2 is an exploded perspective view of a second insulating housing of the card-edge connector.

As shown in FIG. 2, the second insulating housing 12 has a second card receiving slot 120 positioned slightly farther than the first card receiving slot 110 from a surface of the circuit board 2. A plurality of terminal receiving grooves (not shown) is provided next to the second card receiving slot 120. Terminals are arranged within the terminal receiving grooves and are configured for connecting to a second electrical card 4 (FIG. 4). A pivotal shaft 121 is formed on both sides of the second insulating housing 12. A second arm 122 having a substantially L-shape extends transversely from both lateral sides of the second insulating housing 12. The second arm 122 has a second connection portion 123 and a third connection portion 124. The second arm 122 has a positioning post 125 formed on a substantially horizontal section thereof.

As shown in FIG. 2, a first holding member 20 has a pair of holding frames 21 and a pair of insertion sections 22. The holding frames 21 each have a substantially vertical section 210 and a substantially horizontal section 211. A first elastic member 212 is bent and extends inwardly from the horizontal section 211. A first stopping plate 213 is bent and extends outwardly from the vertical section 210. The holding frames 21 are connected with the second connection portions 123 of the second insulating housing 12. The insertion sections 22 each have a substantially vertical section 220 and a substantially horizontal section 221. The vertical section 220 extends outwardly to form a first welding section 222 configured to be fixed to the circuit board 2 (FIG. 3). The insertion sections 22 are connected with the third connection portions 124 of the second insulating housing 12.

As shown in FIG. 1, the second holding member 30 has a pair of supports 31. Each of the supports 31 has a substantially horizontal section 310 and a substantially vertical section 311. A second stopping plate 312 is bent outwardly and extends from a free end of the horizontal section 310. A second elastic member 313 is bent inwardly and extends upward from a lateral side of the second stopping plate 312. A second welding section 314 extends outwardly from a free end of the vertical section 311 and is configured to be fixed to the circuit board 2 (FIG. 3). A hook section 315 extends forwardly from a middle portion of the vertical section 311 so as to be connected with the first connection portion 113 of the first insulating housing 11. A connecting member 316 having a substantially L-shape extends from a joint of the horizontal section 310 and the vertical section 311. When the support 31 is connected with the through-groove 112 of the first insulating housing 11, the connecting member 316 abuts against a surface of the vertical section of the first arm 111. A substantially flat section 317 extends from the connecting member 316 in a direction substantially perpendicular to the horizontal section 310 and the vertical section 311. A flexible bent sheet 318 extends forwardly from a middle portion of the flat section 317. The flat section 317 is connected with the slit 115. The flexible bent sheet 318 is positioned in the groove 114.

As shown in FIG. 4, the partition plate 13 for shielding electromagnetic interference between the first electrical card 3 and the second electrical card 4 includes a pivotal arm 130. The pivotal arm 130 extends forwardly from both lateral sides of a front edge of the partition plate 13. The pivotal arm 130 has an aperture 131 for connecting with the pivotal shaft 121 of the second insulating housing 12 so that the partition plate 13 can rotate between an open position and a closed position from a direction of the second insulating housing 12 toward the first insulating housing 11. A protrusion 132 extends upward from both lateral sides of the partition plate 13. An elastic bent member 133 is disposed at a middle portion of a rear side of the partition plate 13. A through aperture 134 is formed on both sides of the elastic bent member 133 so that the posts 116 of the first insulating housing 11 pass through the through apertures 134 for positioning the partition plate 13.

As shown in FIG. 4, the first electrical card 3 has first positioning apertures 32 disposed on both sides of one end thereof configured for receiving the positioning posts 125 of the second insulating housing 12. The second electrical card 4 has second positioning apertures 40 disposed on both sides of one end thereof configured for receiving the protrusions 132 of the partition plate 13. The first electrical card 3 and the second electrical card 4 may be, for example, Mini PCI Express cards or other memory cards.

Figure 5:
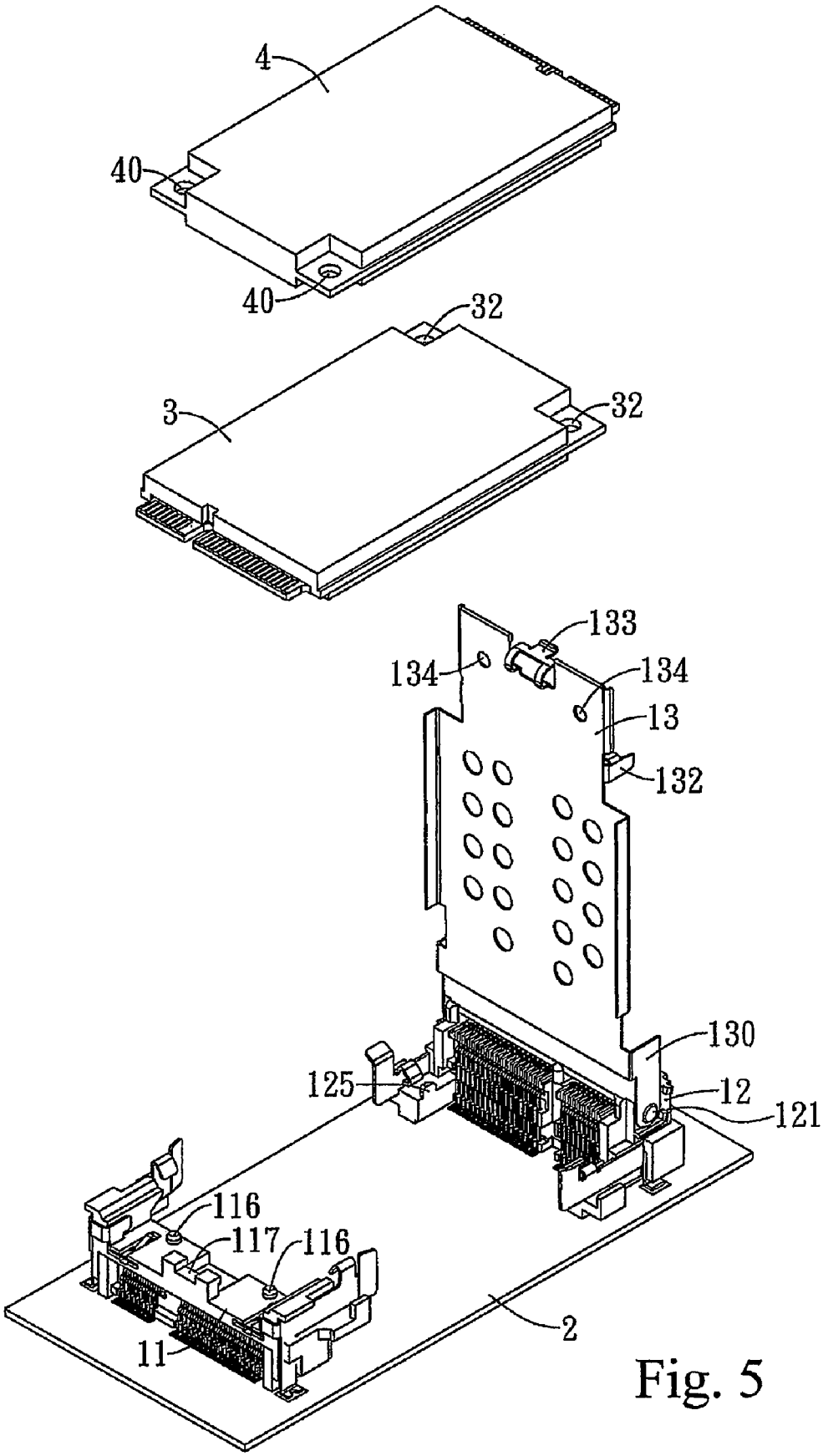
FIG. 5 is an exploded perspective view of the card-edge connector shown with the partition plate assembled to the second insulating housing.
Figure 6:
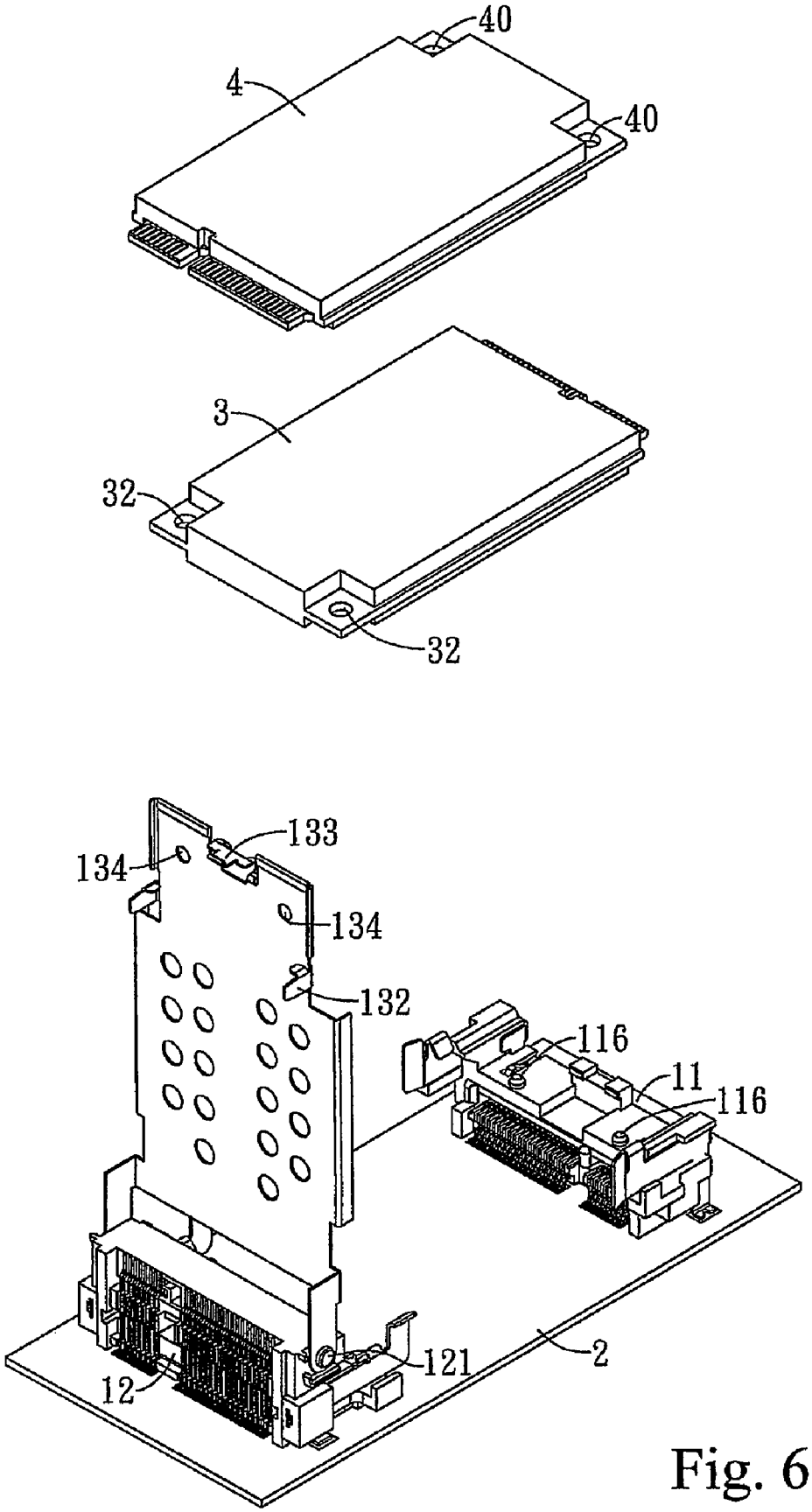
FIG. 6 is another exploded perspective view of the card-edge connector shown with the partition plate assembled to the second insulating housing.
Figure 7:
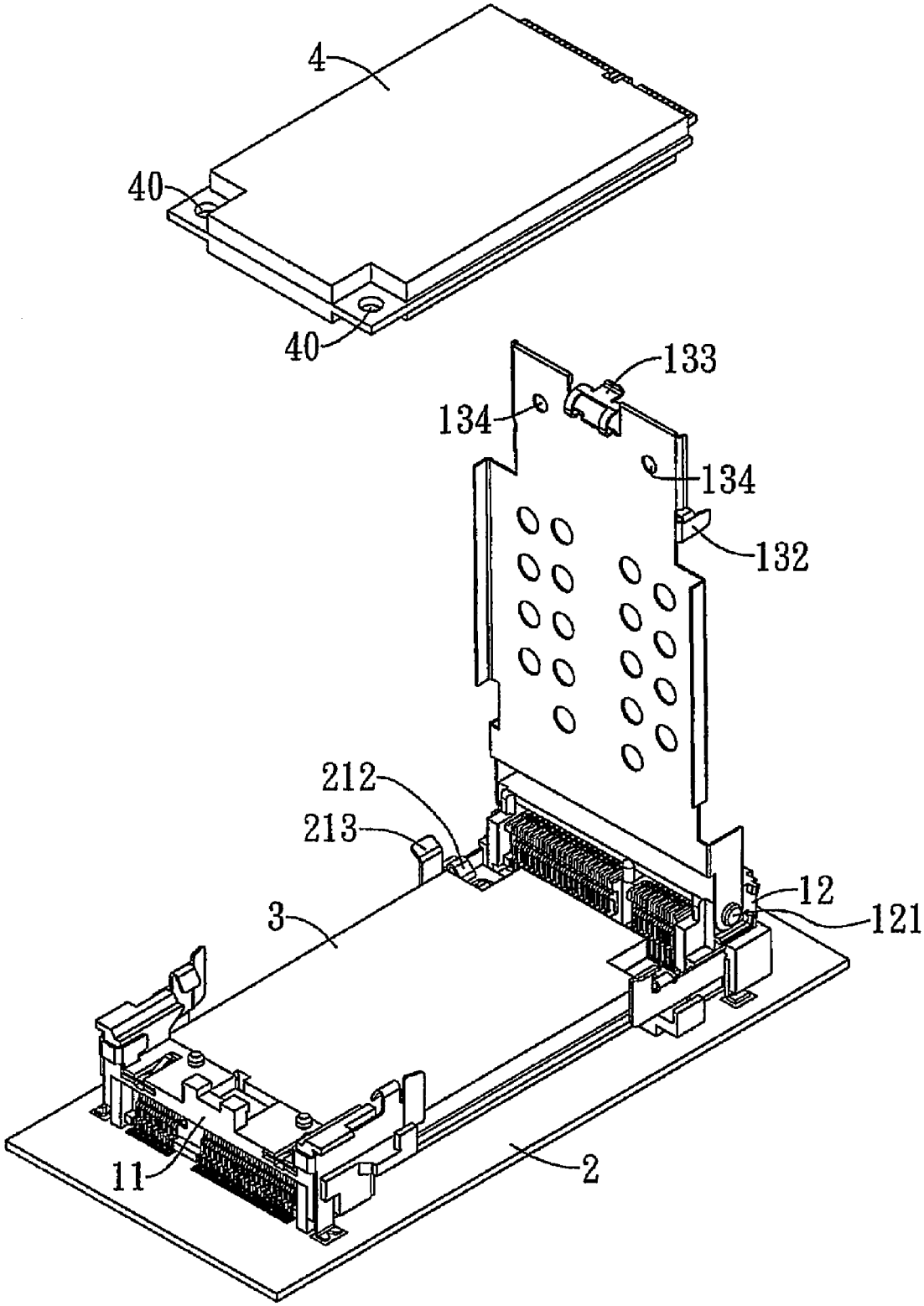
FIG. 7 is an exploded perspective view of the card-edge connector shown with the partition plate assembled to the second insulating housing and one of the electrical cards attached thereto.

The assembly of the card-edge connector 1 will now be described with reference to FIGS. 5-9. As shown in FIGS. 5-6, the first insulating housing 11 and the second insulating housing 12 are oppositely mounted to the circuit board 2 such that the second card receiving slot 120 faces the first card receiving slot 110. The pivotal shaft 121 of the second insulating housing 12 is connected with the aperture 131 of the pivotal arm 130 of the partition plate 13. The partition plate 13 is positioned in the open position, as shown in FIG. 7. The first electrical card 3 is inserted in the first card receiving slot 110 so that the positioning posts 125 of the second insulating housing 12 pass through the first positioning apertures 32 of the first electrical card 3. The first elastic member 212 of the first holding member 20 retains the first electrical card 3 in position. The first electrical card 3 can be detached from the card-edge connector 1 by pressing the first elastic member 212.

Figure 8:
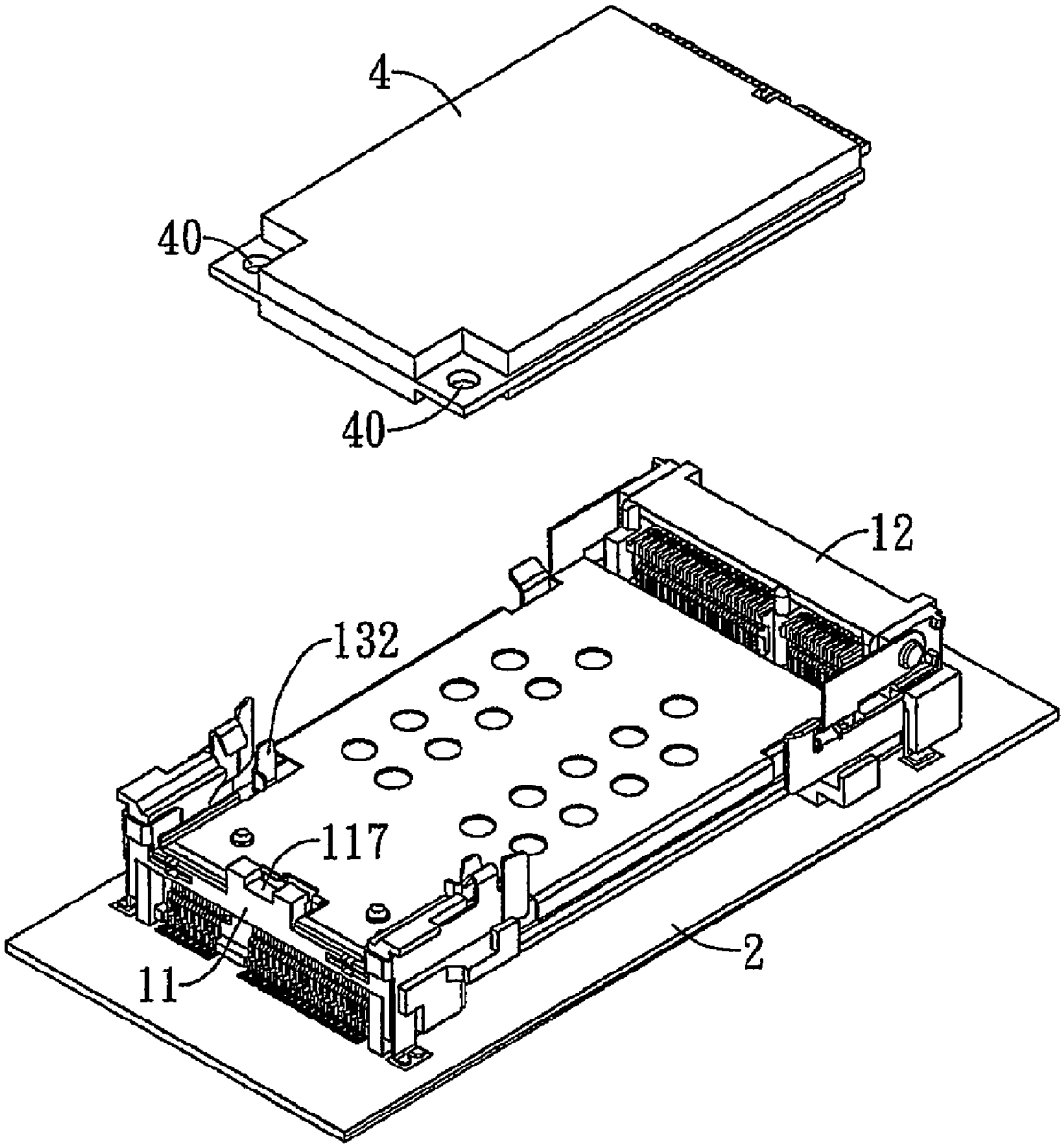
FIG. 8 is an exploded perspective view of the card-edge connector shown with the partition plate assembled to the second insulating housing and in a closed position and one of the electrical cards attached thereto.

The partition plate 13 is then pivoted to the closed position by pivoting the partition plate 13 towards the first insulating housing 11 with the pivotal arm 130 connecting with the pivotal shaft 121, as shown in FIG. 8. The posts 116 of the first insulating housing 11 pass through the through apertures 134 of the partition plate 13, and the partition plate 13, which is held with the positioning projection 117 of the first insulating housing 11 and the elastic bent member 133, substantially covers the first electrical card 3. The partition plate 13 can be pivoted back to the open position by pressing the elastic bent member 133.

Figure 9:
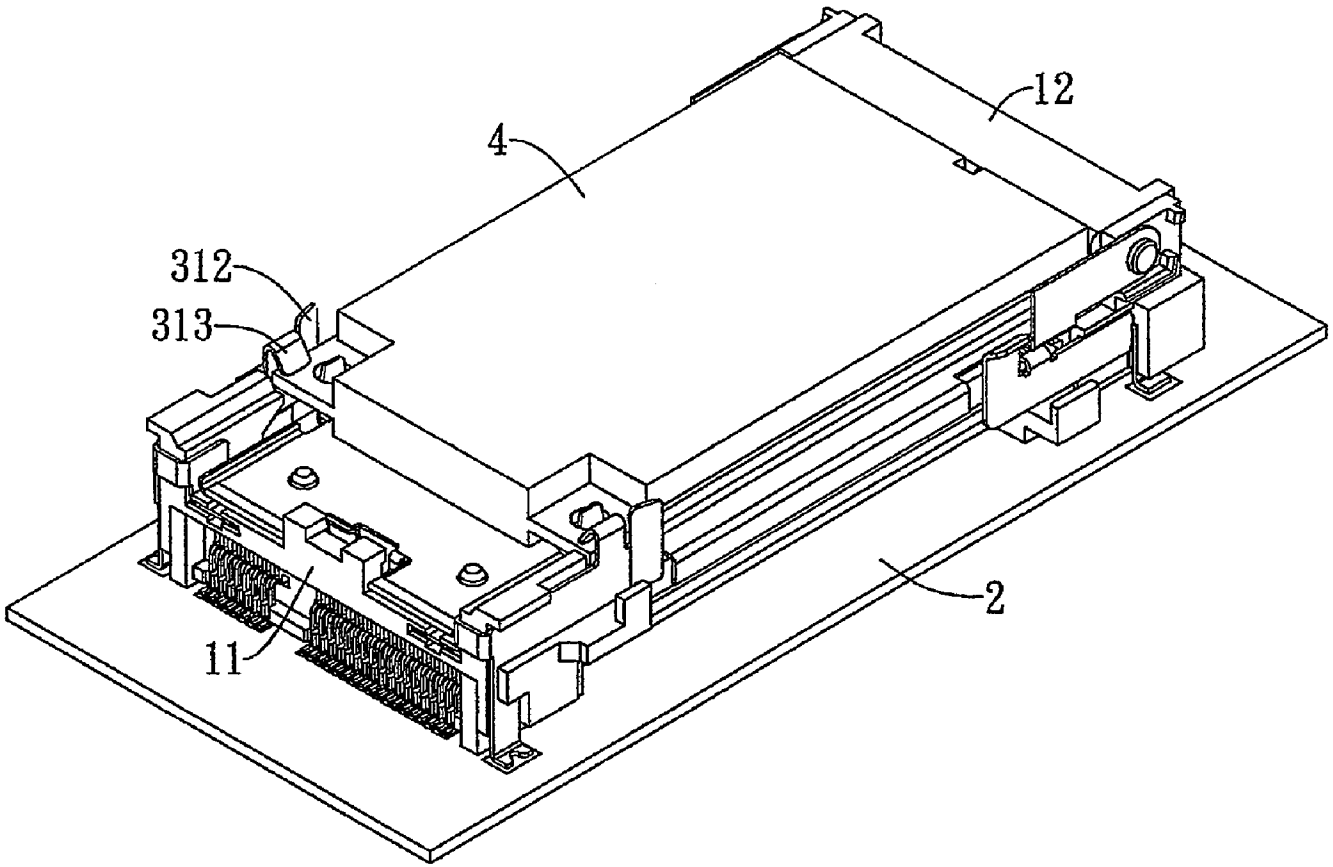
FIG. 9 is a perspective view of the card-edge connector assembly.

As shown in FIG. 9, the second electrical card 4 is inserted in the second card receiving slot 120 in a position opposite from the insertion of the first electrical card 3. The protrusions 132 of the partition plate 13 pass through the second positioning apertures 40 of the second electrical card 4. The second elastic member 313 of the second holding member 30 retains the second electrical card 4 in position. The card-edge connector 1 is thereby electrically connected with the first electrical card 3 and the second electrical card 4. The second electrical card 4 can be detached from the card-edge connector 1 by pressing the second elastic member 313.

In the card-edge connector 1 according to the present invention, the first and second electrical cards 3, 4 can therefore be easily attached to or detached from the card-edge connector 1. Additionally, the first electrical card 3 can be easily secured by the first holding member 20 disposed on the second insulating housing 12, and the second electrical card 4 can be easily secured by the second holding member 30 disposed on the first insulating housing 11. Accordingly, the card-edge connector 1 can secure and electrically connect the first and second electrical cards 3, 4 in a stacked way to save space. Also, the first holding member 20 and the second holding member 30 are constructed and assembled in a simple form for securing the first and second electrical cards 3, 4 to reduce the required components and facilitate attachment and detachment of the first and second electrical cards 3, 4.

Figure 10:
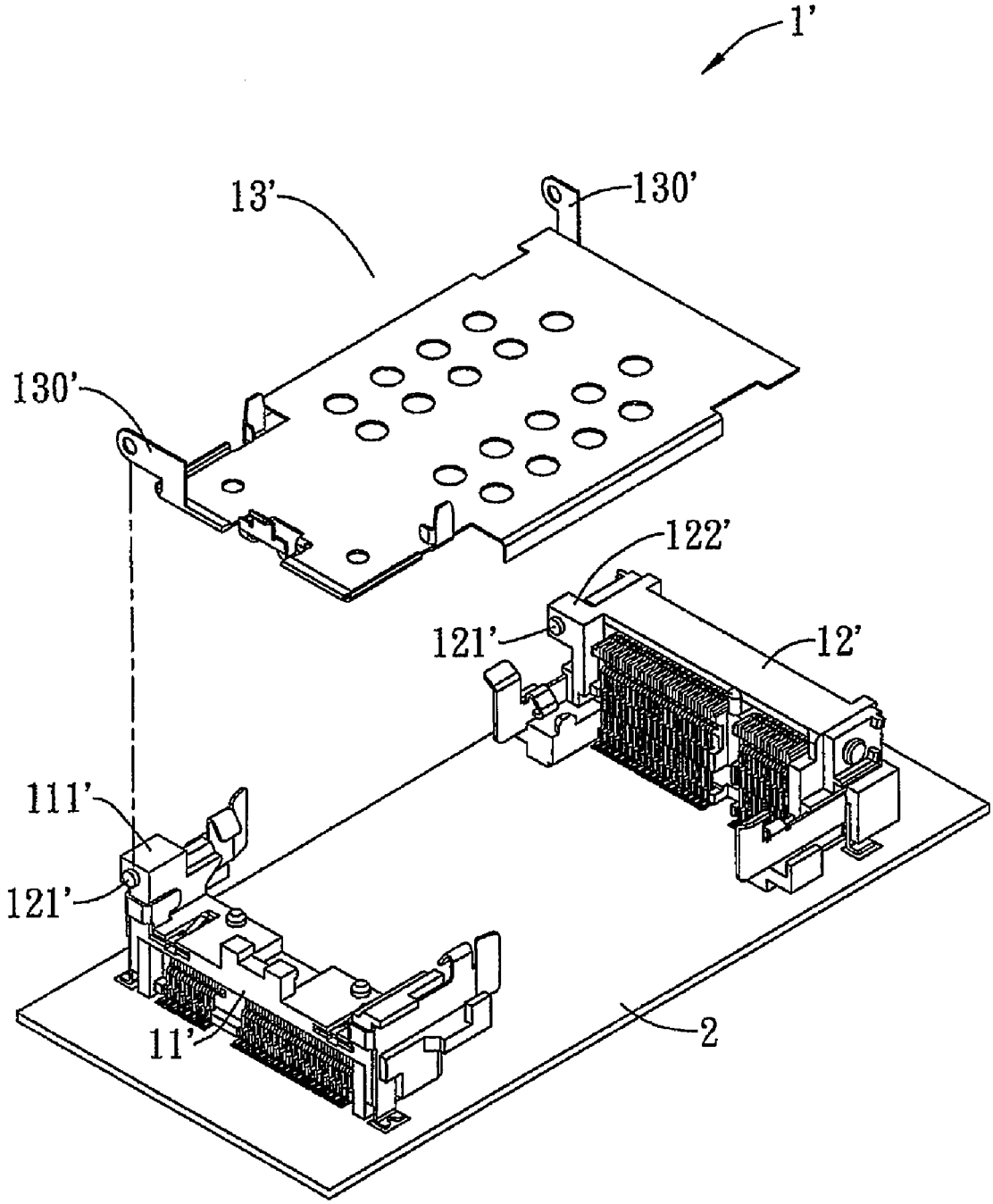
FIG. 10 is an exploded perspective view of a card-edge connector according to a second embodiment of the present invention.

FIG. 10 shows of a card-edge connector 1' according a second embodiment of the present invention. Because the card-edge connector 1' according to the second embodiment is substantially similar to the card-edge connector 1, only the differences there between will be described in greater detail herein. As shown in FIG. 10, the pivotal shaft 121' is disposed not only on one side of the vertical section of the second arm 122' of the second insulating housing 12' but also on one side of the vertical section of the first arm 111' of the first insulating housing 11'. The pivotal arms 130' are provided at two ends of a longitudinal side of the partition plate 13' respectively to correspond to the pivotal shafts 121' formed on the vertical section of the first arm 111' and the second arm 122', respectively. As such, the partition plate 13' can open or close from one side of the first and second insulating housings 11', 12' toward the other side of the first and second insulating housings 11', 12'.

Figure 11:
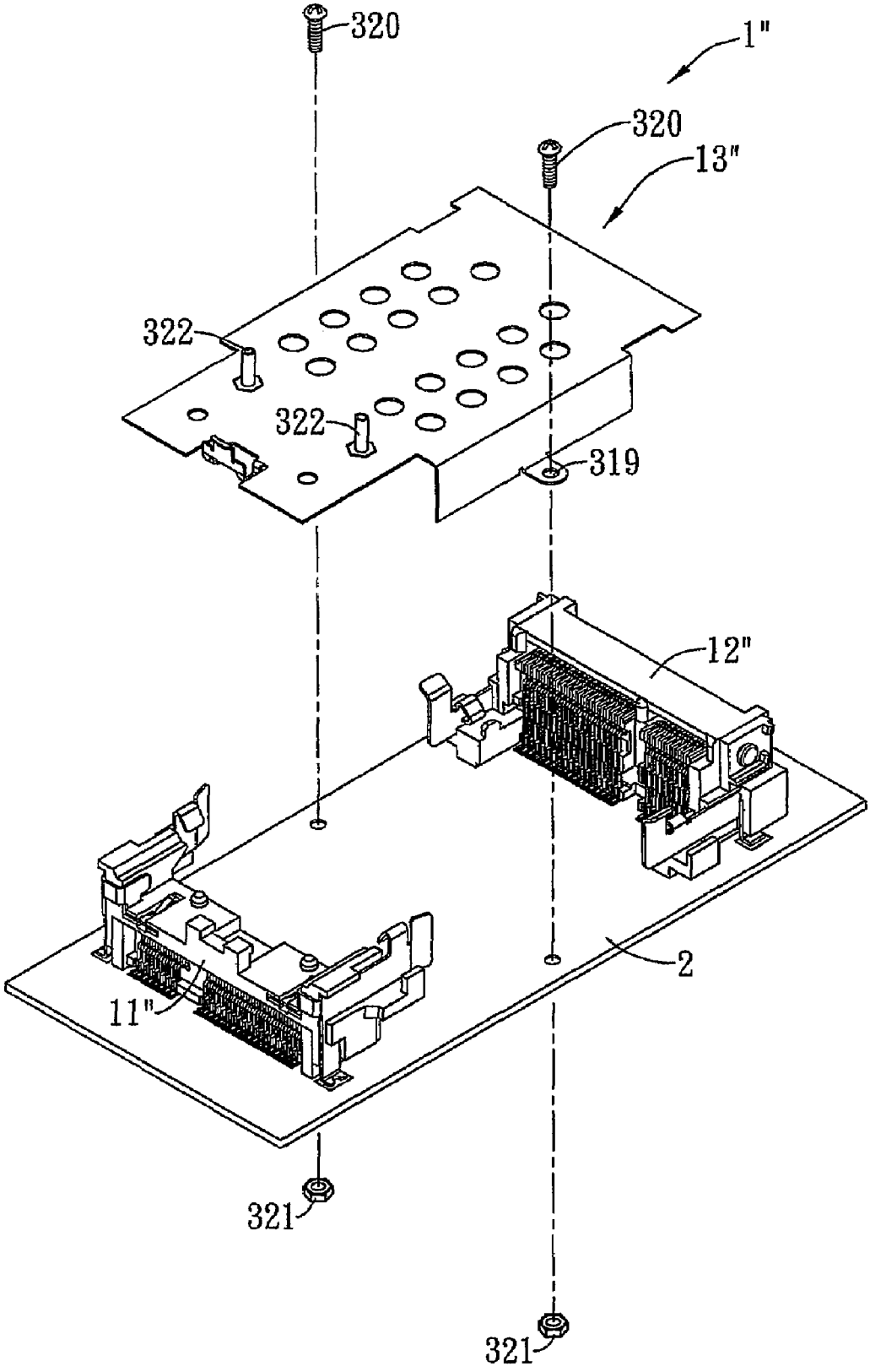
FIG. 11 is an exploded perspective view of a card-edge connector according to a third embodiment of the present invention.

FIG. 11 shows of a card-edge connector 1" according a third embodiment of the present invention. Because the card-edge connector 1" according to the third embodiment is substantially similar to the card-edge connector 1, only the differences there between will be described in greater detail herein. As shown in FIG. 11, instead of fixing the partition plate 13" to the first insulating housing 11" and/or the second insulating housing 12", a screw aperture 319 is formed on a portion extending from both sides of the partition plate 13" to fix the partition plate 13" to the circuit board 2 with a fastening component such as a bolt 320 and a nut 321. Positioning rods 322 are formed on the partition plate 13" to correspond to the second positioning apertures 40 of the second electrical card 4. The positioning rods 322 pass through the second positioning apertures 40 of the second electrical card 4 and are positioned by bolts (not shown) such that the second electrical card 4 is secured.

The foregoing illustrates some of the possibilities for practicing the invention. Many other embodiments are possible within the scope and spirit of the invention. It is, therefore, intended that the foregoing description be regarded as illustrative rather than limiting, and that the scope of the invention is given by the appended claims together with their full range of equivalents.

What is claimed is:

1. A card-edge connector for fixing and electrically connecting at least a first electrical card and a second electrical card to a circuit board, comprising:

a first insulating housing having a first card receiving slot;

a second insulating housing having a second card receiving slot, the second insulating housing being mounted opposite from the first insulating housing such that the second card receiving slot faces the first card receiving slot;

a first holding member disposed on the second insulating housing for retaining the first electrical card in the first card receiving slot; and a second holding member disposed on the first insulating housing for retaining the second electrical card in the second card receiving slot.

2. The card-edge connector of claim 1, wherein the first insulating housing and the second insulating housing are mounted on the circuit board.

3. The card-edge connector of claim 2, wherein the second card receiving slot is positioned farther than the first card receiving slot from a surface of the circuit board.

4. The card-edge connector of claim 2, further comprising a partition plate arranged substantially between the first card receiving slot and the second card receiving slot.

5. The card-edge connector of claim 4, wherein the partition plate is an electromagnetic shield.

6. The card-edge connector of claim 4, wherein the partition plate includes at least one protrusion for engaging with the second electrical card.

7. The card-edge connector of claim 4, wherein the partition plate is mounted to the circuit board.

8. The card-edge connector of claim 4, wherein the partition plate is rotatable between an open position and a closed position.

9. The card-edge connector of claim 8, wherein the partition plate is mounted to the second insulating housing.

10. The card-edge connector of claim 8, wherein the partition plate is mounted to the first insulating housing and the second insulating housing.

11. The card-edge connector of claim 1, wherein the second insulating housing includes at least one positioning post for engaging with the first electrical card.

12. The card-edge connector of claim 1, wherein the first holding member includes a first elastic member for engaging with the first electrical card and the second holding member includes a second elastic member for engaging with the second electrical card.

13. The card-edge connector of claim 12, wherein the first holding member includes a first welding section fixed to the circuit board and the second holding member includes a second welding section fixed to the circuit board.

14. A card-edge connector for fixing and electrically connecting at least a first electrical card and a second electrical card to a circuit board, comprising:

a first insulating housing having a first card receiving slot and a second insulating housing having a second card receiving slot, the first insulating housing and the second insulating housing being mounted on the circuit board such that the second card receiving slot faces the first card receiving slot; and a partition plate arranged substantially between the first card receiving slot and the second card receiving slot.

15. The card-edge connector of claim 14, wherein the partition plate is an electromagnetic shield.

16. The card-edge connector of claim 14, wherein the partition plate includes at least one protrusion for engaging with the second electrical card.

17. The card-edge connector of claim 14, wherein the partition plate is mounted to the circuit board.

18. The card-edge connector of claim 14, wherein the partition plate is rotatable between an open position and a closed position.

19. The card-edge connector of claim 18, wherein the partition plate is mounted to the second insulating housing.

20. The card-edge connector of claim 18, wherein the partition plate is mounted to the first insulating housing and the second insulating housing.

* * * * *